US007132627B2

(12) United States Patent
Peyronny

(10) Patent No.: US 7,132,627 B2
(45) Date of Patent: Nov. 7, 2006

(54) ELECTRIC HEATING UNIT HOUSED IN A CALORIE ACCUMULATOR BLOCK

(76) Inventor: Bernard Peyronny, Mas de la Fauvette, chemin du Trentin, F-84250 Le Thor (FR)

( * ) Notice: Subject to any disclaimer, the term of this patent is extended or adjusted under 35 U.S.C. 154(b) by 0 days.

(21) Appl. No.: 10/486,195

(22) PCT Filed: Aug. 14, 2002

(86) PCT No.: PCT/FR02/02880

§ 371 (c)(1),
(2), (4) Date: Feb. 12, 2004

(87) PCT Pub. No.: WO03/017725

PCT Pub. Date: Feb. 27, 2003

(65) Prior Publication Data

US 2004/0178189 A1 Sep. 16, 2004

(30) Foreign Application Priority Data

Aug. 14, 2001 (FR) ..... 01 10794

(51) Int. Cl.
*H05B 3/06* (2006.01)

(52) U.S. Cl. ..... 219/530; 219/535; 219/540; 392/339; 392/375

(58) Field of Classification Search ..... 219/530, 219/540, 544, 548, 209, 535, 552; 392/502, 392/339, 340, 341, 343, 375, 346, 347, 354; 338/212, 280, 281, 296, 297, 305, 306, 310, 338/283

See application file for complete search history.

(56) References Cited

U.S. PATENT DOCUMENTS 2,099,009 A * 11/1937 Finley et al. ..... 261/103
2,432,400 A * 12/1947 Eger ..... 219/540
2,479,268 A * 8/1949 Sarria ..... 392/339
2,723,338 A * 11/1955 Antoni ..... 392/375
3,686,472 A 8/1972 Harris
4,311,900 A * 1/1982 Hummel ..... 219/535
4,374,316 A * 2/1983 Inamori et al. ..... 219/209
4,558,210 A * 12/1985 Leary ..... 219/535
4,790,901 A * 12/1988 Kettelhoit et al. ..... 156/498
6,180,930 B1 * 1/2001 Wu ..... 219/530
6,259,075 B1 * 7/2001 Wu ..... 219/540
6,418,277 B1 * 7/2002 Golan ..... 392/502

FOREIGN PATENT DOCUMENTS

| | | |
|---|---|---|
| DE | 4128401 | 2/1993 |
| EP | 0818660 | 1/1998 |
| FR | 2721472 | 12/1995 |
| FR | 2760821 | 9/1998 |
| FR | 2770736 | 5/1999 |

* cited by examiner

*Primary Examiner*—Robin O. Evans
*Assistant Examiner*—Leonid Fastovsky
(74) *Attorney, Agent, or Firm*—Greenblum & Bernstein, P. L.C.

(57) ABSTRACT

Heating device having an electric heating body arranged within an accumulator block. The electric heating body includes an insulated flat resister. The accumulator block is structured and arranged to store calories. The heating device is adapted for use in a heating apparatus. This Abstract is not intended to define the invention disclosed in the specification, nor intended to limit the scope of the invention in any way.

30 Claims, 2 Drawing Sheets

ELECTRIC HEATING UNIT HOUSED IN A CALORIE ACCUMULATOR BLOCK

CROSS-REFERENCE TO RELATED APPLICATIONS

The present application is a National Stage Application of International Application No. PCT/FR02/02880, filed Aug. 14, 2002, which published as WO 03/017725 on Feb. 27, 2003. Further, the present application claims priority under 35 U.S.C. § 119 of French Patent Application No. 01/10794 filed on Aug. 14, 2001.

BACKGROUND OF THE INVENTION

1. Field of the Invention

The present invention relates to an electric heating body embedded in a calorie accumulator block.

Generally speaking, it relates to the industrial and commercial field for the production and distribution of primary and auxiliary heating apparatuses that are adapted for all types of premises, such as dwellings, houses, offices, stores, or other private or professional premises.

2. Discussion of Background Information

Currently, central heating systems are increasingly abandoned in favor of self-contained individual units, particularly in residential premises and offices, due to the difficulties to control and optimize energy consumption in large installations.

Electric heating apparatuses generally are radiators constituted of a casing made of steel sheet, provided with an air inlet and outlet and including a single resistance. In most cases, the control is ensured by a thermostat integrated in the apparatus, and in rare cases, by a more developed system that can comprise zone thermostats, an external thermostat, and possibly a scheduler or a power cut-off device.

The control of the current electric radiators is typically an on-off control between two nearly equal temperatures ("differential"). The heat source is alternately shut-off and cold, then connected at its maximum temperature. Recent studies have shown that the impression felt does not correspond to the mean temperature, but rather to the actual lowest temperature. As a result, the need for comfort often leads users to set the thermostat several degrees above the desired temperature, which results in a significant waste of energy.

French Patent No. 2 721 472, filed on Jun. 15, 1994 by the same inventor, describes an electric heating unit constituted of a metallic or non-metallic enclosure containing, in its lower portion, a heating body constituted of a shielded resistance (resistive wire confined in an insulant and in a metallic tube) embedded in a light alloy metallic unit. The heating body is separated from the enclosure by spacers, such that the metallic unit is entirely surrounded by an air cushion. The control of the system is carried out by an electronic device that cuts power for a variable time period during a cycle of about several seconds.

This device makes it possible to produce electric radiators in which the temperature of the heat source does not vary substantially. These apparatuses further have the advantage of accumulating thermal energy while being more compact than the usual accumulation systems, which makes it possible to house them in, for example, communicating doors.

SUMMARY OF THE INVENTION

The device according to the invention provides an improvement to the heating body described in the cited patent, and has a primary object of allowing a reduction in the manufacturing cost by implementing proven techniques derived from those that have already been used in various applications, such as small electric household appliances (iron, hair dryer, etc.).

The invention provides for an accumulator block made of light alloy, cast iron, ceramic or the like, confining a flat resistor arranged between two high-temperature insulating sheets and formed of a dished resistive plate or of a tape wound on an insulating support.

The invention also provides for a heating device comprising an electric heating body arranged within an accumulator block. The electric heating body comprises an insulated flat resister. The accumulator block is structured and arranged to store calories. The heating device is adapted for use in a heating apparatus.

The heating apparatus may comprise one of a primary heating apparatus and an auxiliary heating apparatus. The heating apparatus is adapted to be used in premises, whereby the premises is one of a dwelling, a house, an office, a store, private premises, and professional premises. The electric heating body may be embedded in the accumulator block. The accumulator block may comprise an extruded metallic section. The extruded metallic section may comprise outer walls having wings which diffuse heat. The accumulator block may comprise an assembly of two metallic plates made of an aluminum-base light alloy. The accumulator block may comprise an assembly of two metallic plates made of cast iron. The accumulator block may comprise an assembly of two plates made of ceramic. The accumulator block may be formed from a aluminum mass, and wherein the flat resistor is molded in the aluminum mass.

The flat resistor may be an elongated element and comprises a resistive tape wound on a flat insulating support. The flat resistor may be an elongated element and comprises a resistive material arranged in a meandering pattern. The electric heating body may further comprise two insulating sheets and wherein the flat resistor is arranged between the two insulating sheets. Each of the two insulating sheets may resist high temperatures. Each of the two insulating sheets may be made of composite mica. Each of the two insulating sheets may be made of a material having good heat stability.

The electric heating body may further comprise two insulating sheets and high-temperature insulation, wherein the flat resistor is arranged between the two insulating sheets, and wherein the two insulating sheets are arranged within the high-temperature insulation, whereby the heating device is compliant with Class II arrangements for electric apparatuses.

The electric heating body may further comprise two insulating sheets and two high-temperature insulation sheets, wherein the flat resistor is arranged between the two insulating sheets, wherein the two insulating sheets are arranged within the two high-temperature insulation sheets, and wherein edges of the two high-temperature insulation sheets are pressed against each other. The two high-temperature insulation sheets may form a closed envelope.

The invention also provides for a heating device comprising an electric heating element enclosed by an accumulator block. The electric heating element comprises a flat resister arranged between two insulating sheets. The accumulator block comprises a metal body having external wings.

The electric heating element may be arranged within an opening of the accumulator block. The metal body may comprise two metallic plates. The metal body may comprise two ceramic plates. The flat resistor may be an elongated element and comprises a resistive tape wound on a flat insulating support. The flat resistor may be an elongated element and comprises a resistive material arranged in a meandering pattern. The electric heating element may further comprise high-temperature insulation, wherein the two insulating sheets are arranged within the high-temperature insulation. The high-temperature insulation may comprise two sheets which form a closed envelope.

The invention also provides for a heating arrangement comprising an electric heating device arranged within an accumulator block. The accumulator block is a two-piece metal body which defines an opening structured and arranged to house the electric heating device. The electric heating device comprises a flat resister arranged between two insulating sheets. The flat resistor is an elongated element and comprising one of a resistive tape wound on a flat insulating support and a resistive material arranged in a meandering pattern. A plurality of projecting portions is arranged on opposite sides of the accumulator block.

The invention also provides for a method of providing heating with the heating device described above, wherein the method comprises arranging the electrical heating body within the accumulator block and heating the accumulator block with the electrical heating body.

The invention also provides for a method of providing heating with the heating device described above, wherein the method comprises arranging the electrical heating element within the accumulator block and heating the accumulator block with the electrical heating element.

The invention also provides for a method of providing heating with the heating device described above, wherein the method comprises arranging the electrical heating device within the opening of the two-piece metal body and heating the accumulator block with the electrical heating device.

BRIEF DESCRIPTION OF THE DRAWINGS

In the annexed drawings, provided by way of non-limiting examples of the invention, wherein.

DETAILED DESCRIPTION OF THE INVENTION

The device shown in FIGS. 1–6 utilizes an insulated flat resistor 1 inserted into an accumulator block 2 that is capable of storing calories.

Figure 2:
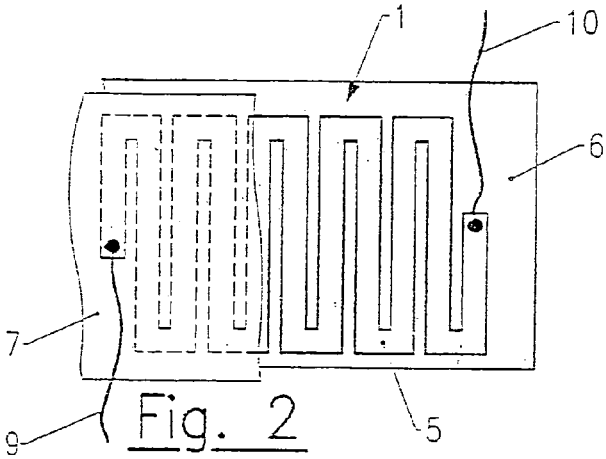
Figure 4:
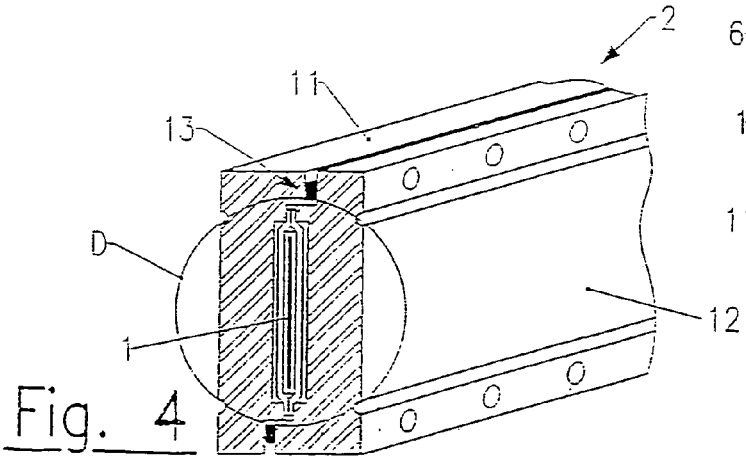
FIG. 4 shows a transverse cross-section of a heating body formed by the assembly of two plates confining a flat resistor.

The resistor 1 consists of an elongated element made of a resistive material in the form of a resistive tape 3 wound on a flat insulating support 4 (FIG. 1) or of a dished plate 5 cut out to form a series of meanders (FIG. 2).

This resistor is enclosed between two insulating sheets 6, 7 resisting high temperatures, made of composite mica or of any other material having good heat stability.

Figure 5:
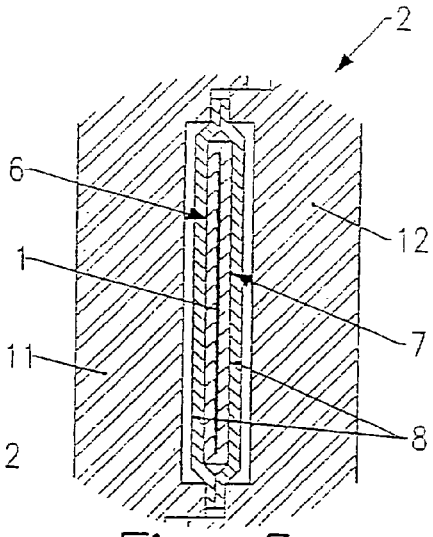
FIG. 5 shows an enlargement of the detail D of FIG. 4.

In the case where a double insulation is necessary (Class II radiators), an additional high-temperature insulation 8 is positioned on each side of the flat resistor 1, which is itself already insulated. To obtain continuity of the additional insulation, the latter is advantageously constituted of two sheets that overlap the assembly formed by the primary insulation and the resistive element, the edges of these sheets being pressed against one another to form a closed envelope (FIG. 5).

In the same manner, the two connecting wires 9, 10 can have a double insulation.

The accumulator block 2 is preferably made of an aluminum-base light alloy, but it can be made of cast iron, ceramic, or of any other material that is capable of storing heat.

Figure 1:
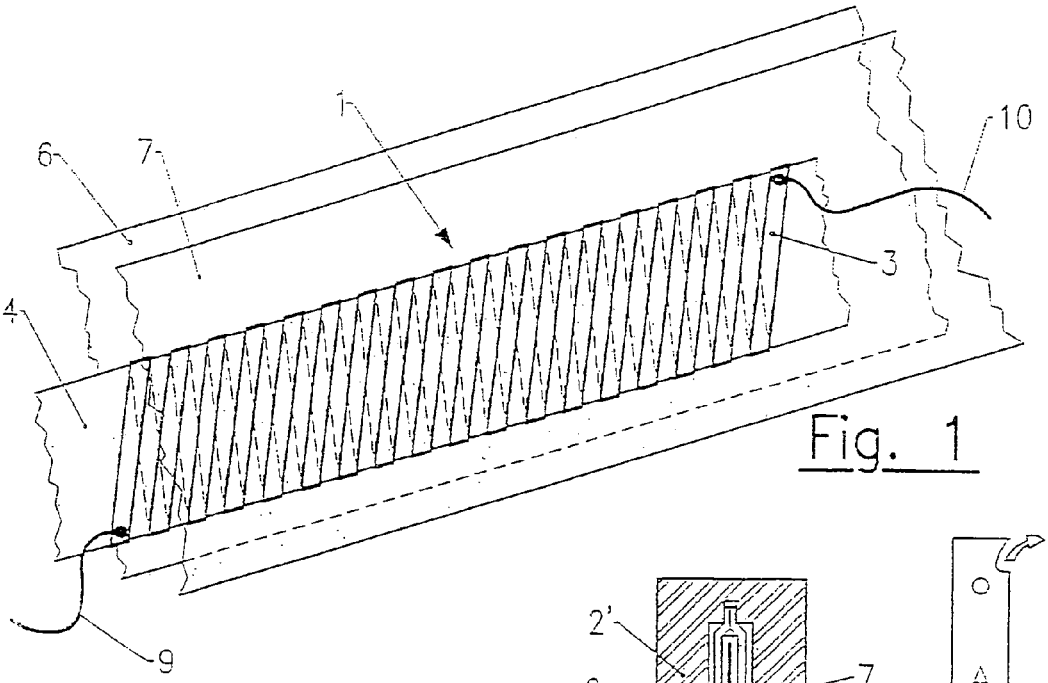
FIGS. 1 and 2 show partial views two variations of flat resistors.
Figure 3:
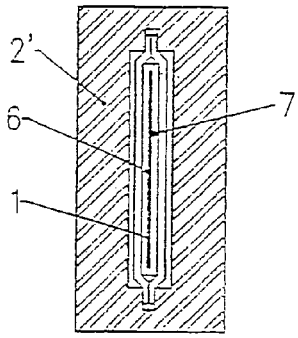
FIG. 3 shows a transverse cross-section of an accumulator block constituted of a metallic section.
Figure 6:
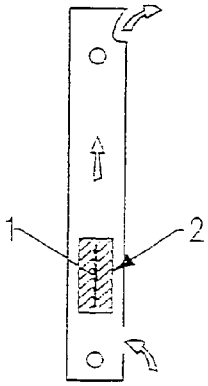
FIG. 6 schematically shows a cross-section of a radiator equipped with a heating body according to the invention.
Figure 7:
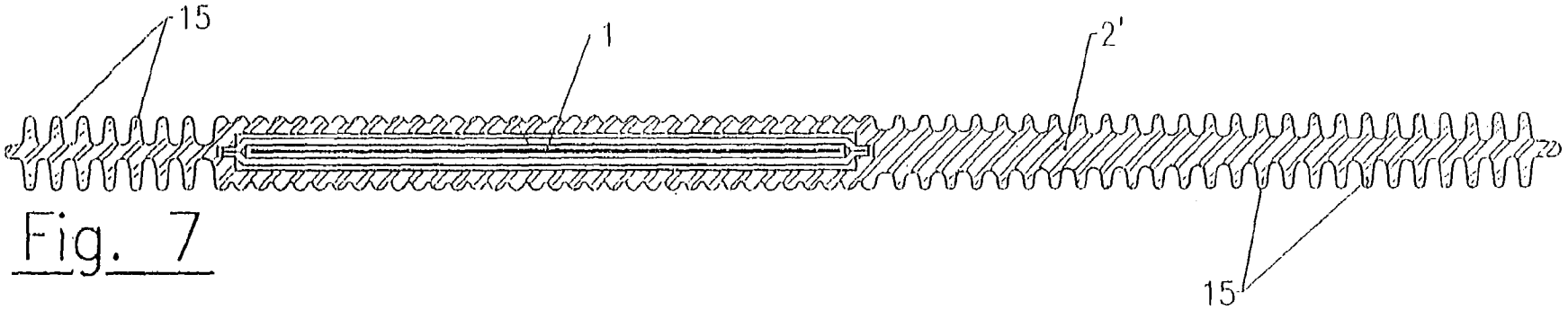
FIGS. 7 and 8 are transverse cross-sections of an accumulator block constituted of a metallic section comprising wings for heat diffusion.
Figure 8:
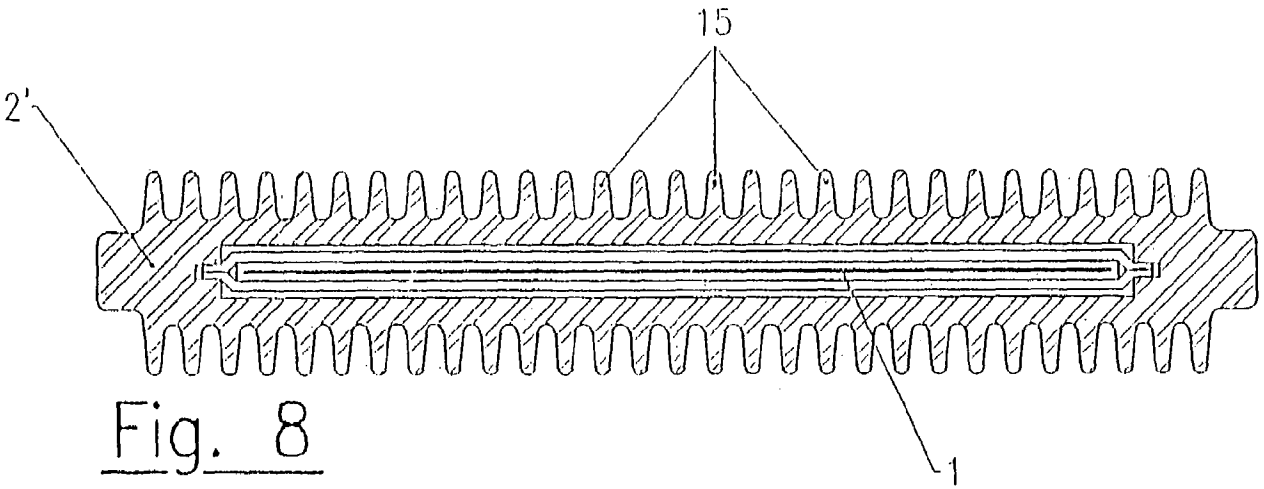

It can be extruded (in the case of aluminum) and machined to form a hollow metallic section 2' (FIG. 3). In order to improve the diffusion of heat, the outer walls of the section are advantageously structured in the form of wings 15 (FIGS. 7 and 8).

The accumulator block 2 can also be constituted of two metallic plates 11, 12 assembled by clips, by screwing or by riveting, the flat resistor 1 being "sandwiched" between these two plates.

As an alternative, the flat resistor 1 can be molded in an aluminum or a cast iron mass (gravity molding of the mass), but this is a more difficult technique to implement.

For the Class II apparatuses, the entire heating body 2 must be waterproof. The waterproofness can be obtained by one or two joints 13 positioned at the interface of the two metallic plates 11, 12.

The positioning of the various constitutive elements provides the object of the invention with a maximum of useful effects which had not, to date, been obtained by similar devices.

The invention claimed is:

1. A heating device comprising:

an electric heating body arranged within a space located inside a metal accumulator block and having opposite edges which extend into openings arranged in the metal accumulator block;

the electric heating body being completely enclosed within the space of the metal accumulator block and having opposite sides which are spaced from inner surfaces of the metal accumulator block;

the electric heating body comprising an insulated flat resistor;

the insulated flat resistor comprising one of a resistive tape wound on a flat insulating support and a resistive plate material arranged in a meandering pattern; and the metal accumulator block being structured and arranged to store calories, wherein the heating device is adapted for use in a heating apparatus.

2. The heating device of claim 1, wherein the heating apparatus comprises one of a primary heating apparatus and an auxiliary heating apparatus.

3. The heating device of claim 1, wherein the heating apparatus is adapted to be used in premises, whereby the premises is one of a dwelling, a house, an office, a store, private premises, and professional premises.

4. The heating device of claim 1, wherein the electric heating body is embedded in the metal accumulator block.

5. The heating device of claim 1, wherein the metal accumulator block comprises an extruded metallic section.

6. The heating device of claim 5, wherein the extruded metallic section comprises outer walls having wings which diffuse heat.

7. The heating device of claim 1, wherein the metal accumulator block comprises an assembly of two metallic plates made of an aluminum-base light alloy.

8. The heating device of claim 1, wherein the metal accumulator block comprises an assembly of two metallic plates made of cast iron.

9. The heating device of claim 1, wherein the metal accumulator block comprises an assembly of two plates made of ceramic.

10. The heating device of claim 1, wherein the metal accumulator block is formed from an aluminum mass, and wherein the insulated flat resistor is molded in the aluminum mass.

11. The heating device of claim 1, wherein the insulated flat resistor is an elongated element and comprises the resistive tape wound on the flat insulating support.

12. The heating device of claim 1, wherein the insulated flat resistor is an elongated element and comprises the resistive plate material arranged in a meandering pattern.

13. The heating device of claim 1, wherein the electric heating body further comprises two insulating sheets and wherein the insulated flat resistor is arranged between the two insulating sheets.

14. The heating device of claim 13, wherein each of the two insulating sheets resists high temperatures.

15. The heating device of claim 13, wherein each of the two insulating sheets is made of composite mica.

16. The heating device of claim 13, wherein each of the two insulating sheets is made of a material having good heat stability.

17. The heating device of claim 1, wherein the electric heating body further comprises two insulating sheets and high-temperature insulation, wherein the insulated flat resistor is arranged between the two insulating sheets, and wherein the two insulating sheets are arranged within the high-temperature insulation, whereby the heating device is compliant with Class II arrangements for electric apparatuses.

18. The heating device of claim 1, wherein the electric heating body further comprises two insulating sheets and two high-temperature insulation sheets, wherein the insulated flat resistor is arranged between the two insulating sheets, wherein the two insulating sheets are arranged within the two high-temperature insulation sheets, and wherein edges of the two high-temperature insulation sheets are pressed against each other.

19. The heating device of claim 18, wherein the two high-temperature insulation sheets form a closed envelope.

20. A heating device comprising:

an electric heating element completely enclosed within a space arranged in a metal accumulator block and having opposite edges which extend into openings arranged in the metal accumulator block;

the electric heating element comprising a flat resistor arranged between two insulating sheets and having opposite sides which are spaced from inner surfaces of the metal accumulator block;

the flat resistor comprising one of a resistive tape wound on a flat insulating support and a resistive plate material arranged in a meandering pattern; and the metal accumulator block comprising external wings.

21. The heating device of claim 20, wherein the metal accumulator block comprises two metallic plates.

22. A heating device comprising:

an electric heating element completely enclosed within a space arranged in an accumulator block and having opposite edges which extend into openings arranged in the accumulator block;

the electric heating element comprising a flat resistor arranged between two insulating sheets and having opposite sides which are spaced from inner surfaces of the accumulator block;

the flat resistor comprising one of a resistive tape wound on a flat insulating support and a resistive plate material arranged in a meandering pattern; and the accumulator block comprising external wings and two ceramic plates.

23. The heating device of claim 20, wherein the flat resistor is an elongated element and comprises the resistive tape wound on the flat insulating support.

24. The heating device of claim 20, wherein the flat resistor is a resistive plate material arranged in a meandering pattern.

25. The heating device of claim 20, wherein the electric heating element further comprises high-temperature insulation, wherein the two insulating sheets are arranged within the high-temperature insulation.

26. The heating device of claim 25, wherein the high-temperature insulation comprises two sheets which form a closed envelope.

27. A heating arrangement comprising:

an electric heating device arranged within an accumulator block and having opposite edges which extend into openings arranged in the accumulator block;

the accumulator block being a two-piece metal body which defines an opening structured and arranged to house the electric heating device;

the electric heating device comprising a flat resistor arranged between two insulating sheets and having opposite sides which are spaced from inner surfaces of the accumulator block;

the flat resistor being an elongated element and comprising one of a resistive tape wound on a flat insulating support and a resistive material arranged in a meandering pattern; and a plurality of projecting portions arranged on opposite sides of the accumulator block.

28. A method of providing heating with the heating device of claim 1, the method comprising:

arranging the electric heating body within the metal accumulator block; and heating the metal accumulator block with the electric heating body.

29. A method of providing heating with the heating device of claim 20, the method comprising:

arranging the electric heating element within the metal accumulator block; and heating the metal accumulator block with the electric heating element.

30. A method of providing heating with the heating device of claim 27, the method comprising:

arranging the electric heating device within the opening of the two-piece metal body; and heating the accumulator block with the electric heating device.

* * * * *